United States Patent [19]

Masumoto et al.

[11] Patent Number: 4,495,691

[45] Date of Patent: Jan. 29, 1985

[54] PROCESS FOR THE PRODUCTION OF FINE AMORPHOUS METALLIC WIRES

[75] Inventors: Tsuyoshi Masumoto, No. 8-22, Uesugi 3-chome, Sendai-shi, Miyagi, Japan; Akihisa Inoue, Miyagi; Michiaki Hagiwara, Kyoto, both of Japan

[73] Assignees: Tsuyoshi Masumoto, Miyagi; Unitika Ltd., Amagasaki, both of Japan

[21] Appl. No.: 362,791

[22] Filed: Mar. 29, 1982

[30] Foreign Application Priority Data

Mar. 31, 1981 [JP] Japan ..... 56-48153

[51] Int. Cl.[3] ..... B22D 11/12; C22C 30/00

[52] U.S. Cl. ..... 29/527.5; 29/DIG. 5; 72/274; 148/403; 164/463; 164/476; 420/580

[58] Field of Search ..... 29/527.4, 527.5, 527.6, 29/527.7, 423, 462, 527.1, DIG. 5; 164/462, 463, 476; 72/274; 148/403; 420/580

[56] References Cited

U.S. PATENT DOCUMENTS

| | | | |
|---|---|---|---|
| 3,715,418 | 2/1973 | Privott, Jr. et al. | 164/462 X |
| 3,715,419 | 2/1973 | Privott, Jr. et al. | 164/462 X |
| 3,856,513 | 12/1974 | Chen et al. | 420/580 X |
| 3,881,542 | 5/1975 | Polk et al. | 164/463 |
| 4,144,058 | 3/1979 | Chen et al. | 75/123 D X |
| 4,300,378 | 11/1981 | Thiruvarudchelvan | 72/274 X |

FOREIGN PATENT DOCUMENTS

| | | | |
|---|---|---|---|
| 2405036 | 8/1974 | Fed. Rep. of Germany | 75/122 |
| 55-64948 | 5/1980 | Japan | 164/463 |

OTHER PUBLICATIONS

Pond, Jr., et al., "A Method of Producing Rapidly Solidified Filamentary Castings", *Transactions of the Metallurgical Society of AIME*, vol. 245, Nov. 1969, pp. 2475–2476.

Takayama, "Amorphous Structures and Their Formation and Stability", *Journal of Materials Science*, vol. 11 (1976), pp. 164–185.

Takayama, "Drawing of Pd 77.5 $Cu_6$ Si 16.5 Metallic Glass Wires", *Materials Science and Engineering*, vol. 38 (1979), pp. 41–48.

Masumoto et al., "Production of Pd–Cu–Si Amorphous Wires by Melt-Spinning Method Using Rotating Water", *Scripta Metallurgica*, vol. 15, No. 3, pp. 293–296 (1981).

*Primary Examiner*—Charlie T. Moon
*Assistant Examiner*—Ronald S. Wallace
*Attorney, Agent, or Firm*—Sughrue, Mion, Zinn, Macpeak, and Seas

[57] ABSTRACT

A process for the production of a fine amorphous metallic wire is described, comprising melt-spinning an iron family element base alloy having an amorphous substance-forming ability to obtain a fine amorphous metallic wire, and passing the thus-formed fine amorphous metallic wire through a die so as to draw within an area reduction percentage range of from about 5 to about 90%. The thus-produced fine amorphous metallic wire of the iron family element base system is excellent in heat resistance, corrosion resistance, electromagnetic characteristics, and has excellent mechanical properties, such as breaking strength and a degree of drawing at break. Thus, it is very useful for various industrial materials such as electric and electronic parts, composite materials, and fibrous materials.

3 Claims, 4 Drawing Figures

PROCESS FOR THE PRODUCTION OF FINE AMORPHOUS METALLIC WIRES

FIELD OF THE INVENTION

The present invention relates to a process for the production of fine wires of amorphous metal, and more particularly, to a process for the production of high quality fine amorphous metallic wires which are made of an iron family element base alloy, have excellent heat resistance, corrosion resistance, and electromagnetic and mechanical characteristics, and are freed of mottles in size.

BACKGROUND OF THE INVENTION

Production of fine metallic wires directly from molten metal would be desirable to reduce production costs. Furthermore, if such a fine metallic wire has an amorphous structure, it will have a great possibility of being put into practical use in a wide variety of fields, such as for electric and electromagnetic parts, composite materials, and fibrous materials, since it has excellent chemical, electromagnetic, and physical properties. In particular, an amorphous metal is superior in mechanical properties to a crystal alloy which is in commercial use; for example, it has a greatly high strength, and is free from work hardening and is high ductile. It has therefore been desired to produce high quality fine amorphous metallic wires which are circular in cross-section and are freed of mottles in size.

Typical methods which have heretofore been proposed to produce fine amorphous metallic wires having a circular cross-section directly from molten metal include (a) a method in which a molten metal is drawn and cool-solidified in a state such that it is covered with glass, utilizing the stringiness of glass (Taylor Process), (b) a method in which a molten metal is jetted from a nozzle into a cooling fluid by the utilization of gravity, etc., and is cooled and solidified therein (which was proposed by Kavesh et al.), and (c) a method in which a cooling liquid medium is introduced into a rotary drum and is used to form a liquid layer on the inner walls of the drum by the action of centrifugal force, and a molten metal is jetted into the liquid layer and is cooled and solidified therein.

In accordance with method (a), however, since the molten metal is covered with glass and air-cooled, the cooling rate is slow, and only fine amorphous wires of small wire diameter can be obtained. Furthermore, since it is composite spinning, the structures of the melting and spinning zones are complicated, and high precision is required. Moreover, it is necessary to remove the glass coating prior to the use as a fine metallic wire.

In accordance with the method (b), it is difficult to control the flow rate of the cooling fluid and to increase the spinning rate, and therefore it is very difficult to produce continuous fine amorphous metallic wires of high quality.

The method (c) is a practical method which is a considerable improvement as compared with the above two methods (a) and (b). In accordance with the method (c), it is possible to control the rate of the cooling liquid and the disturbance thereof, and furthermore, since the stream of molten metal is cooled and solidified by passing it through the rotary cooling liquid by the resultant force of jetting pressure and centrifugal force, the cooling rate is very fast compared with those for the methods (a) and (b), permitting the production of fine amorphous metallic wires of very high wire diameter. However, fine amorphous metallic wires produced directly from an alloy having an amorphous substance-forming ability only by molten spinning have mottles (variations) in size in the longitudinal direction thereof and are not round in cross-section, and therefore, they cannot sufficiently exhibit the features that they possess inherently.

There is known a method in which a fine metallic wire is drawn to improve the uniformity of morphology and mechanical properties. The conventional drawing method, however, incidentally requires special treatments such as planting for coating and heating before and after working, and therefore, it is not a convenient method at all. Furthermore, in the conventional technique, to draw the fine crystal metal wire, it has been the practice to conduct the wire-drawing processing repeatedly, making the sacrifice that the procedure becomes complicated since as the wire-drawing processing is repeated, the mechanical properties are improved.

It is also known, as described in *Nippon Kinzoku Gakkai Shi* (*Journal of the Japanese Learned Society of Metals*), Vol. 44, No. 9, pp. 1084 to 1087 (1980), that a ribbon of amorphous metal can be drawn to make its cross-section circular. This method, however, only has the effect of making the cross-section circular, and does not improve the mechanical properties.

In addition, *Materials Science and Engineering*, pp. 41 to 48, 38 (1979) describes the drawing of fine amorphous wires comprising a $Pd_{77.5}Cu_6Si_{16.5}$ alloy system. When a fine wire is used having a breaking strength: $\sigma_F=148\pm4$ kg/mm$^2$ and a degree of drawing at break: $\epsilon_F=2.27\pm0.16\%$, even if the fine wire is drawn until the area reduction percentage reaches 44%, the breaking strength ($\sigma_F$) and degree of drawing at break ($\epsilon_F$) of the drawn fine wire are $158\pm5$ kg/mm$^2$ and $2.58\pm0.11\%$, respectively. Thus, the drawn fine wire is improved only by 6.8% and 13.7% in the breaking strength and degree of drawing at break, respectively, and it fails to have excellent mechanical properties. Furthermore, the $Pd_{77.5}Cu_6Si_{16.5}$ alloy system is very expensive and is not suitable for practical use.

BRIEF DESCRIPTION OF THE DRAWINGS

FIG. 3(*a*) is a frontal view and FIG. 3(*b*) is a side view.

In FIGS. 1 and 2, (1) denotes a reel having wound thereon a thin wire of amorphous metal produced by melt-spinning, (2) denotes a thin wire of amorphous metal fed from reel (1) to a wiredrawer, (3) denotes five free rollers (having diameters increased stepwise) adapted to be independently and freely rotated around a stationary shaft, (4) denotes dies (arranged in decreasing order of die diameter) for permitting the thin wire of amorphous metal to be drawn, (5) denotes a die support base for keeping the dies (4) in place, (6) denotes drive capstans having diameters successively increased stepwise and secured on a rotary shaft interlocked to a drive motor (7), and (8) denotes a takeup roll operated by the drive motor (7).

In FIG. 3, 9 denotes a quartz tube, (10) denotes a ruby nozzle, (11) denotes a molten alloy, (12) denotes an ejected alloy, (13) denotes an electric furnace, (14) denotes an air piston, (15) denotes a rotating drum, (16) denotes cooling water, (17) denotes a motor, (18) denotes argon gas, (19) denotes a traverse, (20) denotes a supply tube for cooling water (16), (21) denotes a wire specimen, and (22) denotes a thermocouple.

SUMMARY OF THE INVENTION

Figure 1:
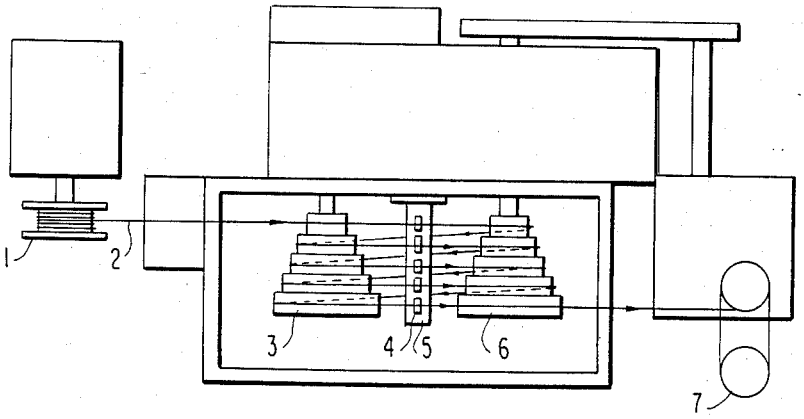
FIG. 1 is a schematic plain view of a conventional wiredrawer which can be employed in the present invention.

The object of the invention is to provide a process for economically and easily producing fine amorphous metallic wires made of iron family element base alloys, which are inexpensive, are excellent in heat resistance, corrosion resistance, electromagnetic characteristics, and particularly in mechanical properties such as breaking strength and a degree of drawing at break, and are useful for various industrial materials such as electric and electronic parts, composite materials, and fibrous materials.

As a result of extensive investigations to attain the object, it has now been found that when fine amorphous metallic wires comprising an iron family element base alloy are drawn under specific conditions, the degree of round in cross-section and mottles in size in the longitudinal direction are improved, and furthermore, the breaking strength and the degree of drawing at break are greatly improved.

The present invention, therefore, provides a process for producing fine amorphous metallic wires which comprises melt-spinning an iron family element base alloy having an amorphous substance-forming ability to form a fine amorphous metallic wire, and passing the metallic wire through a die where it is drawn with an area reduction percentage range of from about 5 to 90%.

DETAILED DESCRIPTION OF THE INVENTION

Fine amorphous metallic wires produced by the process of the invention are very uniform in shapes and properties, are inexpensive, and have good heat resistance, corrosion resistance and electromagnetic characteristics, and are particularly excellent in mechanical properties, i.e., breaking strength and degree of drawing at break, and therefore, they are very useful for various industrial materials such as electric and electronic parts, composite materials, and fibrous materials.

The iron family element base alloys having the amorphous substance-forming ability which are used in the invention are known and described, for example, in *Journal of Materials Science,* Vol. 11, pp. 164 to 185 (1976); *Rapidly Quenched Metals,* III, pp. 197 to 204 (Third International Conference, University of Sussex, Brighton, July 3–7, 1978 Volume 2); *Science,* No. 8, pp. 62 to 72 (1978); *Nippon Kinzoku Gakkai Kaiho* (*A Report of the Japanese Learned Society of Metals*), Vol. 15, No. 3, pp. 151 to 206 (1976); *Kinzoku* (*Metals*) published by Agune Co., Dec. 1, 1971, pp. 73 to 78; and Japanese Patent Application (OPI) Nos. 91014/74 (corresponding to U.S. Pat. No. 3,856,513), 10125/75, 135820/74, 3312/76, 4017/76, 4018/76, 4019/76, 73920/76, 73923/76, 78705/76, 5620/77, 114421/77 and 57120/78 (the term "OPI" as used herein refers to a "published unexamined Japanese patent application").

Typical examples of such iron family element base alloys include an Fe-Si-B alloy system, an Fe-P-C alloy system, an Fe-P-B alloy system, an Ni-Si-B alloy system, an Ni-P-B alloy system, and a Co-Si-B alloy system. Of course, further base alloys can be prepared by appropriately changing the metal-metalloid combination and the metal-metal combination. In addition, there can be prepared base alloys having excellent characteristics which could not be obtained by using conventional crystalline metals.

Of these alloys, Fe base alloy and Co base alloy having excellent heat resistance, corrosion resistance, electromagnetic characteristics and mechanical properties are preferred. These base alloys possess excellent amorphous substance-forming and fine wire-forming abilities. These Fe base alloys and Co base alloys are explained in further detail below.

A particularly preferred Fe base alloy comprises from 0.01 to 75 atm% of one or more groups selected from the groups as set forth below, with the remainder being composed substantially of Fe.

(1) 0.01 to 35 atom% of one or more of P, C, Si, B and Ge (2) 0.01 to 40 atom% of one or two of Co and Ni (3) 0.01 to 15 atom% of one or more of Cr, Nb, Ta, V, Mo, W, Ti, and Zr (4) 0.01 to 5.0 atom% of one or more of Mn, Be, Pd, Al, Au, Cu, Zn, Cd, Sn, As, Sb, Hf, and Pt A particularly preferred Co base alloy comprises from 0.01 to 75 atom% of one or more groups selected from the groups as set forth below, with the remainder being composed substantially of Co.

(1) 0.01 to 35 atom% of one or more of P, C, Si, B, and Ge (2) 0.01 to 40 atom% of one or two of Fe and Ni (3) 0.01 to 15 atom% of one or more of Cr, Nb, Ta, V, Mo, W, Ti and Zr (4) 0.01 to 5.0 atom% of one or more of Mn, Be, Pd, Al, Au, Cu, Zn, Cd, Sn, As, Sb, Hf, and Pt The elements of Group (1) are metalloids necessary for providing the amorphous substance-forming ability. Cobalt (Co) and Ni of Group (2) for the Fe base alloy, and Fe and Ni of Group (2) for the Co base alloy to help to provide desirable electromagnetic characteristics. Of the elements of Groups (3) and (4), Cr, Nb, Ta, V, Mo, W, Ti, Zr, Be, Mn, Sn and Hf help to provide desirable heat resistance and mechanical properties, and Cr, Mo, Ti, Al, Ni, Pd, V, Nb, Ta, W, Pt, Au, Cu, Zr, Cd, As, and Sb help to provide corrosion resistance, such as pitting corrosion resistance and cavity corrosion resistance.

Phosphorus (P), C, Si, B and Ge of Group (1) are elements to promote the formation of the amorphous structure. When the proportion of Group (1) is more than 35 atom%, the production of fine amorphous wires in the rotary cooling liquid tends to become slightly difficult, and the alloy tends to become brittle. It is, therefore, adjusted within the range of from 0.01 to 35 atom%. The optimum proportion of Group (1) for the production of fine amorphous wires is from about 15 to 30 atom%. In particular, Fe-Si-B, Co-Si-B and Fe-P-C alloy systems exhibit excellent amorphous substance-forming and fine wire-forming abilities in the rotary cooling liquid.

The proportion of Co and Ni of Group (2) for the Fe base alloy and that of Ni and Fe of Group (2) for the Co base alloy are both adjusted within the range of 40 atom% or less. Even when both of Co and Ni or both of Ni and Fe are contained therein, the proportion is adjusted within the range of 40 atom% or less. This is because further improvements in the above described characteristics cannot be expected at proportions exceeding 40 atom%. In particular, when Ni is added in a proportion exceeding the above range, the fine wire-forming ability in the rotary cooling liquid tends to decrease, the mottle in size tends to become larger and the production of continuous fine wires tends to become difficult.

The proportion of each of Cr, Nb, Ta, V, Mo, W, Ti and Zr is 15 atom% or less, and when the elements are used in combination with each other, the proportion is adjusted within the range of 15 atom% or less. This is because when the porportion is more than 15 atom%, the amorphous substance forming ability tends to be reduced, and, at the same time, the production of uniform continuous fine wires in the rotary cooling liquid tends to become difficult.

The proportion of each of Mn, Be, Pd, Al, Au, Cu, Zn, Cd, Sn, As, Sb, Hf and Pt is within the range of 5 atom%, and when the elements are used in combination with each other, the proportion is also adjusted within the range of 5 atom%. This is because when the proportion is more than 5 atom%, the amorphous substance-forming ability tends to be reduced.

To the above described alloys can be added small amounts of other elements within the proportions that they do not exert adverse influences on the heat resistance, corrosion resistance, electromagnetic characteristics, and mechanical properties.

In the practice of the invention, fine amorphous metallic wires are produced by a direct melt-spinning method as described hereinbefore. Particularly preferred is the method (c) as described hereinbefore in which the alloy having the amorphous substance-forming ability is jetted through a nozzle into a rotary member containing a cooling liquid and cooled and solidified therein, and thereafter, the wire formed is wound continuously on the inner walls of the rotary member by the action of rotary centrifugal force. This method is described in U.S. patent application Ser. No. 254,714, filed Apr. 16, 1981, and hereby incorporated by reference and hereinafter explained in more detail. Further, this method is illustrated in FIG. 3 and is described in more detail below.

Figure 3A:
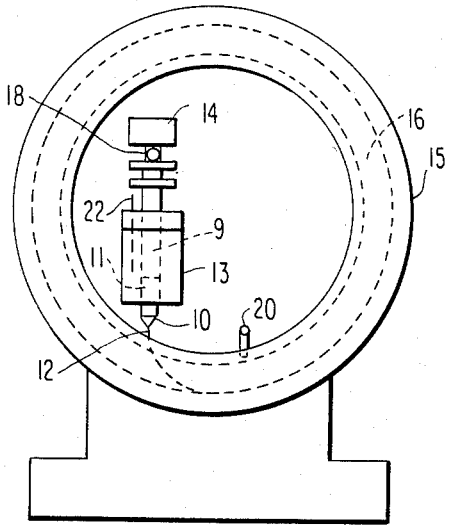
FIG. 3 is a schematic illustration of a melt-quenching apparatus for the production of amorphous wire.
Figure 3B:
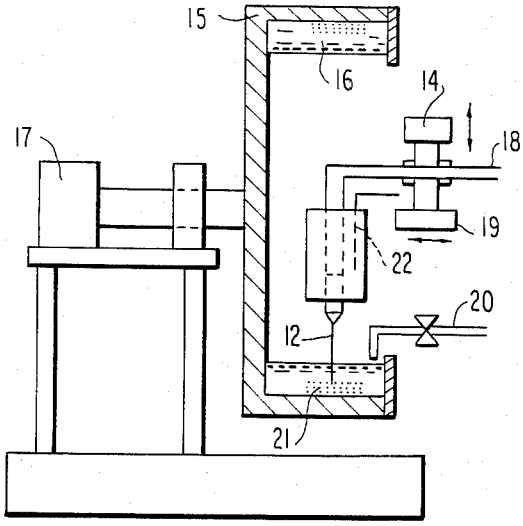

In FIG. 3, quartz tube (9) has a ruby nozzle (10) having one or more spinning openings, which openings are of approximately the same size as the wire filaments. (13) is an electric furnace containing thermocouple (22) for heating to melt the molten alloy (11) which is subjected to melt spinning. (15) is a rotating drum which revolves by means of driving motor (17). (16) is a cooling liquid i.e., water inside rotating drum (10). (20) is a supply tube for cooling water (16). (14) is an air piston for supporting and moving quartz tube (9) up and down. (19) is a traverse for moving quartz tube (9) at a fixed rate to continuously and regularly wind the solidified wire filaments on the inner wall of rotating drum (15). (12) illustrates the alloy which is ejected from ruby nozzle (10) onto the surface of rotating drum (15). In order to prevent oxidation of molten alloy (11), argon gas (18) is introduced into quartz tube (9) to make an inert atmosphere. In this manner, wire specimen (21) is produced.

The bore diameter of the spinning nozzle is 0.25 mm or less. The speed of the rotary member containing the cooling liquid is from 10 to 30% higher than that of the molten metal stream jetted from the spinning nozzle and is preferably as high as possible. When the bore diameter of the spinning nozzle is large and the speed of the rotary cooling liquid is slow, the cooling rate tends to slow down, making it difficult to produce fine amorphous metallic wires. It is preferred to use, as the cooling liquid, water which is at ordinary temperature or at lower temperatures than that, or an aqueous electrolyte solution which is prepared by dissolving a metal salt, for example. However, when this method is used as such, even if the Fe-Si-B alloy system is employed, which has the best amorphous substance-forming and fine wire-forming abilities among the above described alloy systems, and furthermore, the optimum spinning and cooling conditions are employed, the uniformity of the resulting fine wire is such that the degree of round is 97% and the mottle in size is about 4.0%. That is, the ideal complete uniformity cannot be attained, and it fails to fully exhibit the excellent mechanical properties which are characteristic of the amorphous metal.

The fine amorphous metallic wire is then passed through a die where it is subjected to wire-drawing processing. In this case, it is necessary that the area reduction percentage is controlled within the range of from about 5 to about 90%. The wire-drawing processing of the fine amorphous metallic wire within the area reduction percentage range of from about 5 to about 90% permits a significant increase of the uniformity, and furthermore, significantly increases the breaking strength, the degree of drawing at break, the Young's modulus, and the toughness [(breaking strength)×(degree of drawing at break)] to 15% or more, 65% or more, 5% or more, and 80% or more (average) higher than those before the drawing, respectively. In particular, when the fine amorphous metallic wire of the Fe base alloy or Co base alloy is subjected to the wire-drawing processing, there can be obtained high quality and high performance fine amorphous metallic wires whose toughness after the wire-drawing processing is as high as at least 1,100.

If the area reduction percentage is less than 5%, the effect of the wire-drawing processing cannot be expected. The breaking strength and the degree of drawing at break gradually increase with increasing area reduction percentage. At area reduction percentages ranging from 40 to 75%, the breaking strength reaches a maximum, and at higher area reduction percentages than 90%, it abruptly decreases. The degree of drawing at break reaches a maximum at area reduction percentages of from 10 to 50%, and at higher area reduction percentages than 60%, it tends to decrease. In order to produce fine amorphous metallic wires having improved uniformity and at the same time, high toughness, it is preferred to conduct the wire-drawing processing within the range of area reduction percentage of from 10 to 75%. When an Fe base alloy or Co base alloy of high strength and toughness is subjected to the wire-drawing processing within the range of area reduction percentage of from 10 to 75%, the toughness reaches about 1,200 or more, and in some cases, there can be obtained fine amorphous metallic wires having as high a toughness as about 1,850 (breaking strength: 395 kg/mm$^2$; degree of drawing at break: 4.7%).

The area reduction percentage as used herein is determined by the following equation:

$$[(S_1-S_2)/S_1]\times 100(\%)$$

wherein $S_1$ is the average cross-sectional area of fine amorphous metallic wire before drawing, and $S_2$ is the average cross-sectional area of fine amorphous metallic wire after drawing.

In the wire-drawing processing, a diamond die, for example, is used, and one or more fine amorphous metallic wires are provided with a suitable oil agent and passed therethrough one or more times at ordinary temperature (5° to 35° C.). The number of passage can be appropriately determined since it varies depending on the diameter of wire, the diameter of die, and the pitch. The cross-section of the fine amorphous metallic wire is determined by the form of the die.

Figure 2:
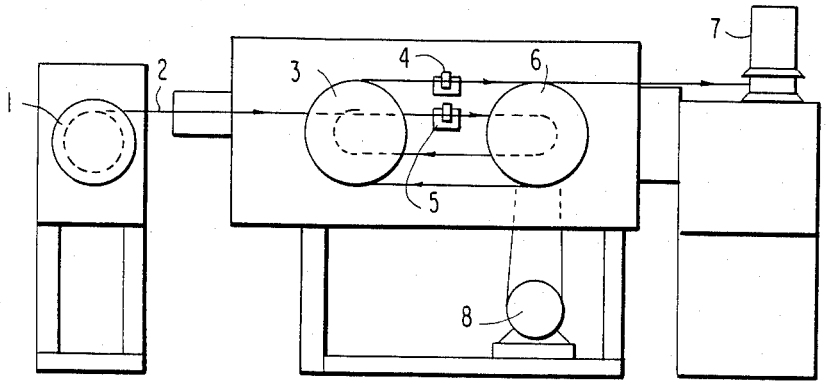
FIG. 2 is a schematic front view of the wiredrawer of FIG. 1.

More specifically, with reference to FIGS. 1 and 2, the thin wire of amorphous metal (2) wound on reel (1) ready for drawing is passed around first-step roller (3) (with the free rollers of sequential steps adapted to be independently and freely rotated), drawn through first-step die (4) secured on die base (5), led to first-step drive capstan (6) interlocking to drive motor (7). Drive capstan (6) imparts to the wire the drawing tension required for withdrawing and affects the first-step wire drawing. Subsequently, the thin wire of amorphous metal (2) which has been passed around first-step drive capstan (6) is led to second-step free roller (3), passed through second-step die (4) (naturally having a smaller diameter than the first-step die) to undergo the second-step wire-drawing, and led to second-step drive capstan (6) having a larger diameter than the first-step capstan and exposed there to the drawing tension required for the second-step wiredrawing.

In this manner, the wire is drawn repeatedly in successive steps (five steps in the illustrated wiredrawer) with a draft adjusted to fall in the range of about 5 to 90%, and then led to and wound on the takeup roll operated by drive motor (7).

The following Examples and Comparative Examples are given to illustrate the invention in greater detail.

In the examples, the breaking strength was measured as follows:

A 2.0 cm long specimen was mounted on an Instron type tensile tester and tested at a rate of distortion of $4.2\times10^{-4}$/sec to measure a load at the breakage thereof. The breaking strength is a value as calculated by dividing the load (kg) by the original average cross-sectional area ($mm^2$) of the specimen.

The degree of drawing at break is the degree of drawing (%) of the specimen at the breakage thereof.

The mottle in size was measured as follows:

A 10 m long specimen was measured in diameter at 10 points selected at random along the length thereof, and the difference between the maximum and minimum diameters and the average diameter were obtained. The mottle in size is a value as calculated by the equation:

$$\frac{\text{Difference between Maximum and Minimum Diameters}}{\text{Average Diameter}} \times 100$$

The degree of round is a value calculated by the equation:

$$\frac{Rmin}{Rmax} \times 100$$

wherein Rmax and Rmin are the diameters of the longest axis and shortest axis, respectively, for the same cross section.

EXAMPLES 1 TO 4 AND COMPARATIVE EXAMPLE 1

An alloy consisting of 75 atom% Fe, 10 atom% Si and 15 atom% B was melted in an argon atmosphere, jetted through a spinning nozzle having a bore diameter of 175 μm under an argon gas pressure of 3.5 $kg/cm^2G$, and introduced at an angle of 60° into a rotary cooling water of depth of 2.5 cm placed in a rotary drum having an inner diameter of 500 mm to obtain a fine amorphous metallic wire having an average diameter of 150 μm, a degree of round of 96%, a mottle in size of 4.5%, a breaking strength of 304 $kg/mm^2$, a degree of drawing at break of 2.8%, a toughness of 851%.$kg/mm^2$, and a Young's modulus of $12.1\times10^3$ $kg/mm^2$. The jetting rate of the molten metal was 430 m/min, the speed of the rotary drum was 500 m/min, and the distance between the spinning nozzle and the surface of the cooling liquid was maintained at 2 mm.

The jetting rate of the molten metal was calculated from the weight of the metal collected after jetting into the atmosphere for a predetermined period of time.

Then, the fine amorphous metallic wire was drawn at ordinary temperature (25° C.) at different area reduction percentages as shown in Table 1 by the use of a diamond die, and the breaking strength, the degree of drawing, and the Young's modulus after the drawing were measured.

The results are tabulated in Table 1.

For all the wires of Example Nos. 1 to 4 and Comparative Example No. 1, the degree of round was 100%, and the mottle in size in the longitudinal direction was 0%.

TABLE 1

| Example No. | Diameter of Last Die (μm) | Area Reduction Percentage (%) | Breaking Strength ($kg/mm^2$) | Degree of Drawing (%) | Toughness (% · $kg/mm^2$) | Young's Modulus ($kg/mm^2$) |
|---|---|---|---|---|---|---|
| Example 1 | 140 | 12.9 | 357 | 4.0 | 1428 | $12.2\times10^3$ |
| Example 2 | 120 | 36.0 | 368 | 4.4 | 1619 | $12.5\times10^3$ |
| Example 3 | 100 | 55.6 | 375 | 4.5 | 1688 | $12.8\times10^3$ |
| Example 4 | 79 | 72.3 | 371 | 3.8 | 1410 | $13.5\times10^3$ |
| Comparative Example 1 | 39 | 93.2 | 330 | 2.9 | 957 | $13.5\times10^3$ |

The fine wires produced by drawing the fine amorphous metallic wires of $Fe_{7.5}Si_{10}B_{15}$ in Example Nos. 1 to 4 were high toughness fine amorphous metallic wires which were round in cross section, were freed of mottles in size, and were uniform. Compared with those before the drawing, the breaking strength, the degree of drawing at break, and the toughness could be increased by 17 to 23%, 35 to 60%, and 65 to 95%, respectively. In addition, the Young's modulus could be increased, although the degree was small. Comparative Example No. 1 is outside the scope of the invention, because the drawing was conducted up to an area reduction percentage of 93.2%. The breaking strength and the degree of drawing at break abruptly decreased, and even if the wire was more drawn, no beneficial effect could be expected.

The Young's modulus was a value as determined by the gradient of a tangent line at a degree of drawing of 0.5% on the S—S curve which was measured at a distortion rate of $4.2\times10^{-4}$/sec by the use of an Instron type tensile tester.

EXAMPLES 5 TO 14

Fe base alloys, Co base alloys, and Ni base alloys having the compositions shown in Table 2 were each melted, jetted through a spinning nozzle having a bore diameter of 150 μm at an argon gas pressure of 4.0 kg/cm$^2$G, and introduced into a 20% aqueous solution of sodium chloride having a depth of 2.5 cm which was placed in a rotary drum having an inner diameter of 500 mm and maintained at −15° C. to obtain a fine amorphous metallic wire having an average diameter of 125 μm. The speed of the rotary drum was 525 m/min, the angle at which the molten metal was introduced was 80°, and the speed at which the molten metal was jetted through the spinning nozzle was 435 m/min.

For the thus-obtained fine amorphous metallic wires, the breaking strength, the degree of drawing at break, the toughness [(breaking strength)×(degree of drawing at break)], the degree of round, and the mottle in size were measured, and the results are shown in Table 2.

TABLE 2

| Example No. | Alloy Composition (atom %) | Breaking Strength (kg/mm$^2$) | Degree of Drawing (%) | Toughness (% · kg/mm$^2$) | Degree of Round (%) | Mottle in Size (%) |
|---|---|---|---|---|---|---|
| 5 | $Fe_{68}Ta_5Si_{10}B_{17}$ | 311 | 3.0 | 933 | 96 | 6.5 |
| 6 | $Fe_{67}Cr_8Si_{10}B_{15}$ | 317 | 3.2 | 1014 | 97 | 5.5 |
| 7 | $Fe_{49}Co_{20}Nb_5Al_1Si_{10}B_{15}$ | 322 | 2.8 | 902 | 96 | 6.0 |
| 8 | $Co_{72.5}Si_{12.5}B_{15}$ | 307 | 3.1 | 952 | 95 | 5.0 |
| 9 | $Co_{58}Nb_{14.5}Si_{12.5}B_{15}$ | 328 | 2.9 | 951 | 94 | 6.5 |
| 10 | $Fe_{65}Cr_{10}P_{13}C_{12}$ | 272 | 3.1 | 843 | 96 | 5.5 |
| 11 | $Fe_{59}Cr_{10}P_{17}C_7B_7$ | 283 | 3.0 | 849 | 95 | 7.0 |
| 12 | $Co_{70}Fe_7Ni_7Si_{10}B_6$ | 290 | 3.1 | 899 | 94 | 8.5 |
| 13 | $Fe_{70}Ni_8Si_{10}B_{12}$ | 272 | 3.2 | 870 | 94 | 7.0 |
| 14 | $Ni_{48}Fe_{30}Si_8B_{14}$ | 255 | 2.8 | 714 | 92 | 10.0 |

In Example Nos. 5 through 9, fine amorphous metallic wires of the alloys were obtained which were excellent in heat resistance and strength; in Example Nos. 10 and 11, fine amorphous metallic wires of the alloys were obtained which were excellent in corrosion resistance and strength; and in Example Nos. 12 through 14, fine amorphous metallic wires of the alloys were obtained which were excellent in electromagnetic characteristics. For all the fine amorphous metallic wires, however, the degree of round and the mottle in size were not sufficiently satisfactory, and the breaking strength, the degree of drawing at break, and the toughness did not yet reach the levels that the fine amorphous metallic wire inherently possessed.

The thus-produced fine metallic wires (above Example Nos. 5 to 14) were drawn at ordinary temperature (25° C.) at the area reduction percentages shown in Table 3 by the use of a diamond die.

The results obtained are shown in Table 3.

TABLE 3

| Example No. | Area Reduction Percentage (%) | Breaking Strength (kg/mm$^2$) | Degree of Drawing (%) | Toughness (% · kg/mm$^2$) | Degree of Round (%) | Mottle in Size (%) |
|---|---|---|---|---|---|---|
| 5 | 48 | 384 | 4.7 | 1805 | 100 | 0 |
| 6 | 36 | 390 | 4.8 | 1872 | 100 | 0 |
| 7 | 36 | 394 | 4.2 | 1655 | 100 | 0 |
| 8 | 20 | 360 | 3.9 | 1404 | 100 | 0 |
| 9 | 48 | 391 | 4.2 | 1642 | 100 | 0 |
| 10 | 36 | 330 | 4.3 | 1419 | 100 | 0 |
| 11 | 48 | 345 | 4.2 | 1449 | 100 | 0 |
| 12 | 59 | 365 | 4.0 | 1460 | 100 | 0 |
| 13 | 48 | 340 | 4.1 | 1394 | 100 | 0 |
| 14 | 60 | 320 | 3.9 | 1248 | 100 | 0 |

As can be seen from Table 3, the fine amorphous metallic wires produced in Example Nos. 5 through 14 were all completely uniform (degree of round: 100%; mottle in size: 0%).

From the results shown in Table 3, it appears that in order to make uniform wires having a large mottle in size, the area reduction percentage should be slightly increased. However, by drawing within the range of area reduction percentage of 20 to 60%, the mottle in size formed during the spinning, cooling and solidifying procedures can be completely removed. Furthermore, since the breaking strength and the degree of drawing at break were significantly increased, fine amorphous metallic wires having very high toughness could be obtained.

EXAMPLES 15 TO 16 AND COMPARATIVE EXAMPLE 2

In the same manner as in Example 5 except that $Fe_{66.5}P_{12.5}C_{11}$ (atom%) was used as an alloy, there was obtained a fine amorphous metallic wire having an average diameter of 150 μm, a degree of round of 92%, a mottle in size of 6.7%, a breaking strength of 293 kg/mm$^2$, a degree of drawing of 2.5%, and a toughness of 745%.kg/mm$^2$.

The thus-produced fine amorphous metallic wire was subjected to a single wire-drawing processing at ordinary temperature so that the average diameter be 147 μm (area reduction percentage: 4.0%; Comparative Example 2), 146 μm (area reduction percentage: 5.3%; Example 15), or 143 μm (area reduction percentage: 9.1%; Example 16).

The results are shown in Table 4.

TABLE 4

| Example No. | Average Diameter (μm) | Area Reduction Percentage (%) | Breaking Strength (kg/mm²) | Degree of Drawing (%) | Toughness (% · kg/mm²) | Degree of Round (%) | Mottle in Size (%) |
|---|---|---|---|---|---|---|---|
| Comparative Example 2 | 147 | 4.0 | 305 | 2.6 | 780 | 95 | 1.6 |
| Example 15 | 146 | 5.3 | 311 | 2.9 | 902 | 100 | 0 |
| Example 16 | 143 | 9.1 | 318 | 3.0 | 954 | 100 | 0 |

Table 4 demonstrates that with the fine wire of Comparative Example 2 in which the area reduction percentage was less than 5%, the uniformity and mechanical strength were not improved to the extent that was desired, whereas with the fine wires of Example Nos. 15 and 16, the uniformity and mechanical properties were improved to the extent that the effect of drawing could be appreciated, and improved fine amorphous metallic wires were obtained.

COMPARATIVE EXAMPLE 3

An alloy consisting of 77.5 atom% Pd, 6 atom% Cu and 16.5 atom% Si was used and melted at a temperature of 1,050° C., and thereafter, was processed in the same manner as in Example 5 to obtain a fine amorphous metallic wire having an average diameter of 125 μm. For the thus-produced fine amorphous metallic wire, the breaking strength was 142 kg/mm², the degree of drawing at break was 2.0%, the toughness was 284%.kg/mm², the degree of round was 88%, the mottle in size was 5.5%, and it was of low breaking strength and low toughness.

The thus-produced fine amorphous metallic wire was drawn at ordinary temperature (25° C.) by the use of a diamond die to a diameter of 90 μm (area reduction percentage, 48%), and thereafter the breaking strength and the degree of drawing at break were measured and found to 149 kg/mm² and 2.2%, respectively. Thus, the wire was a fine amorphous metallic wire of low breaking strength and low toughness.

While the invention has been described in detail and with reference to specific embodiments thereof, it will be apparent to one skilled in the art that various changes and modifications can be made therein without departing from the spirit and scope thereof.

What is claimed is:

1. A process for producing a fine amorphous metallic wire of substantially circular cross-section comprising the steps of:

(a) selecting an Fe base alloy comprising: from 0.01 to 75 atom% of one or more groups selected from the groups as set forth below, with the remainder being composed substantially of Fe:

(1) 0.01 to 35 atom% of one or more of P, C, Si, B and Ge;

(2) 0.01 to 40 atom% of one or two of Co and Ni;

(3) 0.01 to 15 atom% of one or more of Cr, Nb, Ta, V, Mo, W, Ti, and Zr;

(4) 0.01 to 5.0 atom% of one or more of Mn, Be, Pd, A, Au, Cu, Zn, Cd, Sn, As, Sb, Hf, and Pt;

(b) providing a sufficient quantity of said alloy in a molten state;

(c) jetting said molten alloy, said alloy having an amorphous substance forming ability, through a spinning nozzle into a cooling liquid contained within a rotary member, whereby said liquid causes solidification of said molten alloy thereby producing said fine amorphous metallic wire;

(d) continuously winding upon the inner walls of said rotary member by the action of centrifugal force, the alloy wire thus formed;

(e) removing said alloy wire from said rotary member; and (f) passing said alloy wire through a die thus drawing said alloy wire within an area reduction percentage range from about 5% to about 90%.

2. A process for producing a fine amorphous metallic wire of substantially circular cross-section comprising the steps of:

(a) selecting a Co base alloy comprising: from 0.01 to 75 atom% of one or more groups selected from the groups as set forth below, with the remainder being composed substantially of Co:

(1) 0.01 to 35 atom% of one or more of P, C, Si, B, and Ge;

(2) 0.01 to 40 atom% of one or two of Fe and Ni;

(3) 0.01 to 15 atom% of one or more of Cr, Nb, Ta, V, Mo, W, Ti and Zr;

(4) 0.01 to 5.0 atom% of one or more of Mn, Be, Pd, A, Au, Cu, Zn, Cd, Sn, As, Sb, Hf, and Pt;

(b) providing a sufficient quantity of said alloy in a molten state;

(c) jetting said molten alloy, said alloy having an amorphous substance forming ability, through a spinning nozzle into a cooling liquid contained within a rotary member, whereby said liquid causes solidification of said molten alloy thereby producing said fine amorphous metallic wire;

(d) continuously winding upon the inner walls of said rotary member by the action of centrifugal force, the alloy wire thus formed;

(e) removing said alloy wire from said rotary member; and (f) passing said alloy wire through a die thus drawing said alloy wire within an area reduction percentage range from about 5% to about 90%.

3. A process as in claim 1 or 2, wherein the drawing is conducted at an area reduction percentage range of from about 10 to about 75%.

* * * * *